US005218164A

United States Patent [19]

Magorian

[11] Patent Number: 5,218,164

[45] Date of Patent: Jun. 8, 1993

[54] DUAL GATE TARGET DETECTING DEVICE (TDD)

[75] Inventor: William R. Magorian, China Lake, Calif.

[73] Assignee: The United States of America as represented by the Secretary of the Navy, Washington, D.C.

[21] Appl. No.: 668,769

[22] Filed: Mar. 18, 1976

[51] Int. Cl.[5] ..... F42C 13/04

[52] U.S. Cl. ..... 102/214

[58] Field of Search ..... 102/70.2 P, 19.2, 397, 102/211-214; 343/7 PF; 342/68

[56] References Cited

U.S. PATENT DOCUMENTS 3,853,065 12/1974 Apstein ..... 102/70.2 P
3,906,493 9/1975 Adrian et al. ..... 102/70.2 P
3,913,104 10/1975 Adrian et al. ..... 102/70.2 P

*Primary Examiner*—Charles T. Jordan
*Attorney, Agent, or Firm*—Melvin J. Sliwka; John L. Forrest, Jr.

[57] ABSTRACT

A proximity fuze for a foliage penetrating weapon provides for airburst at a predetermined height above ground, regardless of terrain features, by inhibiting the warhead detonation signal until the desired height is reached.

6 Claims, 2 Drawing Sheets

DUAL GATE TARGET DETECTING DEVICE (TDD)

BACKGROUND OF THE INVENTION

This invention relates to weapon detonation fuze systems and more particularly to a proximity fuze providing a detonation inhibit signal until a predetermined height is reached regardless of terrain features.

Prior art fuze systems utilized for foliage penetration are of two general types. The first type is the proximity fuze system which relies primarily upon delaying detonation of the warhead for a fixed time interval after detecting the top of the foliage. Such systems are not able to contend with varying foliage depth and open terrain and thus fail to provide warhead detonation positioned The second type is the contact fuze system, frequently used as a backup to the proximity fuze, which often functions upon entry into dense vegetation, thereby causing detonation to occur at a non-optimum height.

SUMMARY OF THE INVENTION

In accordance with the present invention, RF energy is transmitted, reflected, received and outputted as a processed signal for object detection. The processed signal is coupled into parallel range channels which develop the range limits of each channel and then into a logic circuit which detects the presence of an object within the range limits of each channel. A first range channel provides a detonation signal upon detection of an object within a first predetermined range. Additional range channels provide a detonation inhibit signal upon detection of an object within a second predetermined range which is greater than and exclusive of the first predetermined range. When the object detected within the second predetermined range moves outside of the second predetermined range the inhibit signal is removed and, if an object is still detected within the first range channel, ordnance detonation occurs.

DETAILED DESCRIPTION OF AN EMBODIMENT

Figure 1:
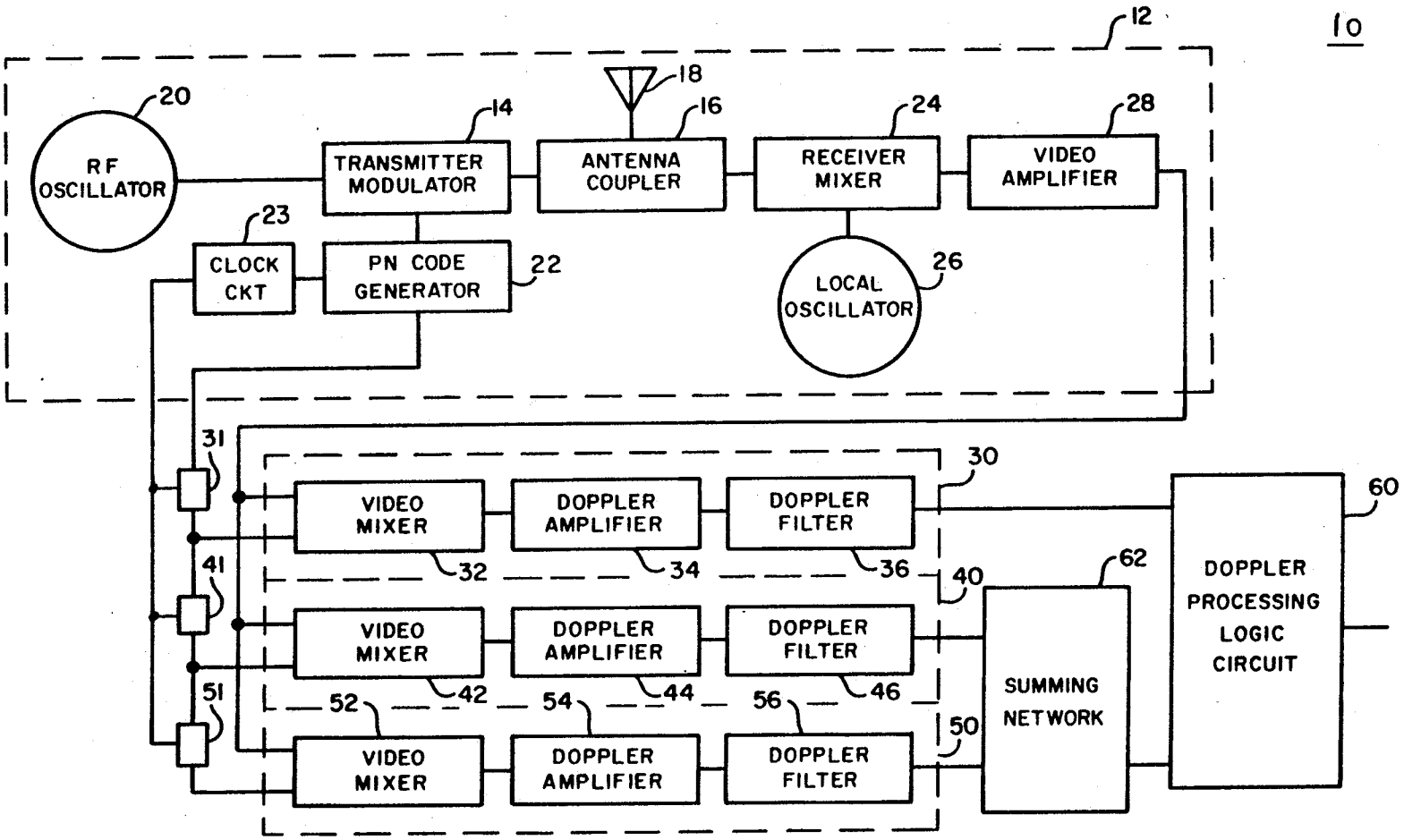
FIG. 1 is a block diagram of a proximity fuze incorporating the present invention.

Referring to FIG. 1, the present invention is a proximity fuze 10 utilizing a psuedo-noise doppler radar transmit-receive system 12 which includes a transmit modulator 14 having an output connected to an input of an antenna coupler 16. An RF oscillator 20 has an output connected to an input of transmit modulator 14 and a psuedo-noise code generator 22 has an output connected to another input of transmit modulator 14. An output of a clock circuit 23 is connected to an input of psuedo-noise code generator 22.

Antenna coupler 16 has outputs connected to an antenna 18 and to a receiver mixer 24. A local oscillator 26 has an output connected to an input of receiver mixer 24.

The output of receiver mixer 24 is connected to a video amplifier which in turn has its output connected to a video mixer 32 which is contained with a first range channel 30. The video amplifier 28 output is also coupled into a video mixer 42 contained within a second range channel 40. Additional range channels may be utilized as shown by connecting the video amplifier 28 output to a video mixer 52 of a third range channel 50.

An output of clock circuit 23 is parallel connected to inputs of a first delay flip-flop 31, a second delay flip-flop 41 and a third delay flip-flop 51. An output of code generator 22 is connected into first delay flip-flop 31. The output of first delay flip-flop 31 is connected to video mixer 32 and to second delay flip-flop 41. The output of second delay flip-flop 41 is connected to video mixer 42 and to third delay flip-flop 51. The output of third delay flip-flop 51 is connected to video mixer 52.

The output of video mixer 32 is connected to an input of a doppler amplifier 34 which in turn has an output connected to the input of a doppler filter 36. The output of video mixer 42 is connected to the input of a doppler amplifier 44 which in turn has an output connected to the input of a doppler filter 46. The output of video mixer 52 is connected to an input of doppler amplifier 54 which in turn has an output connected to the input of a doppler filter 56.

The output of the first range channel 30 is connected to an input of a doppler processing logic circuit 60. If only two range channels are utilized, the output of the second range channel 40 is connected into another input of the doppler processing logic circuit 60. If, however, more than two range channels are used, the outputs of the second and additional range channels are connected to inputs of a summing network 62 and the output of summing network 62 is connected to an input of the doppler processing logic circuit 60.

Figure 2:
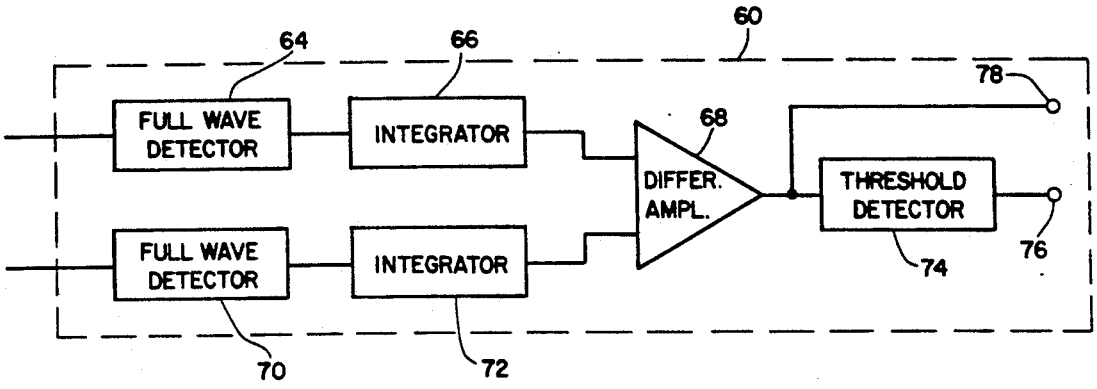
FIG. 2 is a block diagram of the logic circuit used in FIG. 1.

Referring now to FIG. 2, the output of the first range channel 30 is connected to a full wave detector 64 contained within the doppler processing logic circuit 60. The output of fullwave detector 64 is connected to an input of integrator 66 which has its output connected to differential amplifier 68 at its positive input port.

The output of the second range channel 40 or in case more than two range channels are utilized, the output of the summing network 62 is connected to the input of a fullwave detector 70 contained within the doppler processing logic circuit 60. The output of fullwave detector 70 is connected to an integrator 72 which has an output connected to differential amplifier 68 at its negative input port.

The output of differential amplifier 68 is connected to threshold detector 74 which has a firing signal output 76.

In operation, two frequencies, one generated in the RF oscillator 20 and the second generated in the pseudo-noise code generator 22, are coupled into transmit modulator 14. The resultant modulated signal is coupled through antenna coupler 16 to the antenna 18 for transmission. Backscattered energy of the transmitted signal from objects in space is received by antenna 18 and coupled through antenna coupler 16 into the receiver mixer 24 where it is mixed with a signal coupled from local oscillator 26. A clock signal from clock circuit 23 is coupled into the pseudo-noise code generator 22 for developing a code frequency. The clock signal is also parallel coupled into the first, second,and third delay flip-flops 31, 41, 51. The code frequency signal from generator 22 is coupled, into first delay flip-flop 31. The delayed code frequency signal is coupled from first delay flip-flop 31 into video mixer 32 and second delay flip-flop 41. The delay code frequency signal of delay flip-flop 41 is coupled into video mixer 42 and into third delay flip-flop 51. The delayed code frequency signal of delay flip-flop 51 is coupled into video mixer 52. The correlated signals of the video mixers 32, 42, 52 are then coupled through their respective doppler amplifiers 34, 44, 54 into their respective doppler filters 36, 46, 56. Thus, each range channel 30, 40, 50 establishes an unique range gate output signal corresponding to a predetermined range extending from the fuze 10. The first range gate output signal corresponds to a predetermined range 80 (shown in FIG. 3) extending from fuze 10 outwardly a predetermined distance. The second range gate output signal corresponds to a second predetermined range 82 exclusive of the first predetermined range, and the third range gate output signal to a third predetermined range 84 exclusive of the first and second predetermined ranges. The range channels may be adjusted to provide a guard band 81 between each predetermined range.

Figure 3:
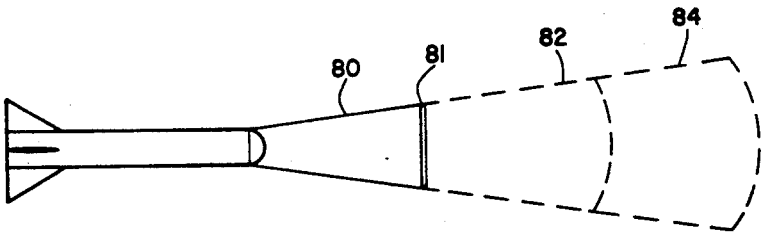
FIG. 3 is a pictural view of a projectile incorporating the invention.

The second and third range gate output signals are coupled to summing network 62 where they are summed to provide a single range gate output signal corresponding to an extended predetermined range 82, 84 (as shown in FIG. 3) which is exclusive of the first predetermined range.

The first range gate output signal is coupled into fullwave detector 64 for detection of objects within the first predetermined range 80. The output of the fullwave detector 64 is coupled through integrator 66 into the positive port of differential amplifier 68.

The output signal from summing network 62 is coupled it full wave detector 70 for detection of objects within the extended predetermined range 82, 84. The output of full wave detector 70 is coupled through integrator 72 into the negative port of differential amplifier 68.

Differential amplifier 68 algebraically sums the signals coupled into its positive and negative input ports. The resultant signal is then outputted and coupled into threshold detector 74.

Threshold detector 74 has its threshold level set to a predetermined positive voltage. As a detected object moves from the extended predetermined range 82, 84 into the first predetermined range 80, the signal coupled into threshold detector 74 approaches the predetermined threshold level. When the threshold detector 74 input signal reaches the threshold level, a fine signal is generated and outputted on firing signal output 76.

If additional objects are detected in the extended predetermined range 82, 84, the amplitude of the negative signal in differential amplifier 68 will be sufficient to prevent the threshold detector 74 input signal from reaching the threshold level. Thus, no fire signal will be generated until the detected objects move from the extended predetermined range 82, 84 into the first predetermined range 80.

Some detonation devices may require an arming signal in addition to the fire signal on output 76. An arming signal may be obtained by providing an additional output 78 from differential amplifier 68.

While a psuedo-noise doppler system is disclosed as the best mode contemplated for the transmit-receive system 12, for other applications, other T-R systems, such as a coherent oscillator pulsed doppler system, for example, may be used.

What is claimed is:

1. A proximity fuze for a projectile comprising:

means for generating and transmitting radio frequency energy;

processing means for receiving said transmitted energy as a reflected signal and providing an output signal;

at least one range channel means connected to said processing means output for receiving said processing means output signal and providing a first range gate output signal;

at least a second range channel means connected to said processing means output for receiving said processing means output signal and providing a second range gate output signal;

logic means having inputs and outputs;

said first range gate output signal being operatively coupled to one of said logic means inputs;

said second range gate output signal being operatively coupled to another of said logic means inputs;

said logic means being operative to provide an output signal at one of said outputs when only one of said first and second range gate output signals is present at one of the inputs to said logic means.

2. The fuze of claim 1 wherein:

said first range gate output signal is responsive to detection of an object within a first predetermined range from said fuze; and said second range gate output signal is responsive to detection of an object within a second predetermined range from said fuze, said second predetermined range extending a greater distance from said fuze than said first predetermined range and being exclusive of said first predetermined range; and said logic means being operative to provide a firing signal output when only said first range gate output signal is present at one of the inputs to said logic means.

3. The fuze of claim 1 further including:

at least a third range channel means connected to said processing means output for receiving said processing means output signal and providing a third range gate output signal; and said third range gate output signal being operatively coupled to another of said logic means inputs; and said logic means being operative to provide an output signal at one of said outputs when only one of said first, second and third range gate output signals is present at one of the inputs to said logic means.

4. The fuze of claim 2 further including;

at least a third range channel means connected to said processing means output for receiving said processing means output signal and providing a third range gate output signal; and said third range gate output signal being operatively coupled to another of said logic means inputs; and said third range gate output signal is responsive to detection of an object within a third predetermined range from said fuze, said third predetermined range extending a greater distance from said fuze than said first and second predetermined range and being exclusive of said first and second predetermined range; and said logic means being operative to provide a firing signal output when only said first range gate output is present at one of said inputs to said logic means.

5. The fuze of claim 3 wherein; said logic means is responsive to predetermined ones of said range gate signals present at one of said inputs to said logic means to provide an armed signal output at one of said logic means outputs.

6. The fuse of claim 4 wherein;

said logic means is responsive to at least one of the range gate output signals present at one of said inputs to said logic means to provide an armed signal output at one of said logic means outputs.

* * * * *